US005088632A

United States Patent [19]

Odet et al.

[11] Patent Number: 5,088,632

[45] Date of Patent: Feb. 18, 1992

[54] LIQUID-TIGHT CLOSURE ASSEMBLY WITH MULTIDIRECTIONAL ORIENTATION AND RETRACTIBLE POURER TUBE

[75] Inventors: Philippe Odet, Chasselay; Jean Y. Rognard, Trevoux, both of France

[73] Assignee: Astra Plastique, Saint Georges de Reneins, France

[21] Appl. No.: 571,576

[22] PCT Filed: Jan. 22, 1990

[86] PCT No.: PCT/FR90/00044

§ 371 Date: Sep. 5, 1990

§ 102(e) Date: Sep. 5, 1990

[87] PCT Pub. No.: WO90/08074

PCT Pub. Date: Jul. 26, 1990

[30] Foreign Application Priority Data

Jan. 23, 1989 [FR] France ..... 89 00982

[51] Int. Cl.[5] ..... B65D 47/06

[52] U.S. Cl. ..... 222/529; 222/530; 222/538; 222/568; 222/570

[58] Field of Search ..... 222/527-530, 222/538, 567-570

[56] References Cited

U.S. PATENT DOCUMENTS

| | | | |
|---|---|---|---|
| 3,204,827 | 9/1965 | Krautkrämer | 222/530 X |
| 3,928,577 | 1/1967 | Chlystun | 222/530 X |
| 4,073,413 | 2/1978 | Tabler et al. . | |
| 4,560,081 | 12/1985 | Adams . | |
| 5,004,126 | 4/1991 | Klesius | 222/529 X |

FOREIGN PATENT DOCUMENTS

| | | | |
|---|---|---|---|
| 0177456 | 4/1986 | European Pat. Off. . | |
| 0224863 | 6/1987 | European Pat. Off. | 222/538 |
| 0226783 | 7/1987 | European Pat. Off. | 222/530 |
| 0385104 | 9/1990 | European Pat. Off. | 222/528 |
| 148592 | 8/1920 | United Kingdom | 222/530 |

*Primary Examiner*—Kevin E. Shaver

*Attorney, Agent, or Firm*—Parkhurst, Wendel & Rossi

[57] ABSTRACT

A leaktight stopper unit and pouring tube for a container having an opening surrounded by a cylindrical neck having an intermediate element which includes inner and outer generally cylindrical sleeves connected by a top surface defining a cylindrical cavity for placement over the cylindrical neck of a container. A pouring tube which includes a memory effect bellows and which is retractible into the annular intermediate element, a removable closing stopper having a top portion such that an inner face of the top portion contacts the top of the pouring tube to compress the pouring tube in a retracted position substantially within the annular intermediate element. The inner sleeve of the annular intermediate element is sized to fit snugly with a cylindrical neck of a container and additionally comprises an integrally extending shoulder flange for retaining the pouring tube within the intermediate element.

8 Claims, 4 Drawing Sheets

131
132
120
101
115
117
119
136
130
135
114
112
111
113
140
124
142
145
100
102

LIQUID-TIGHT CLOSURE ASSEMBLY WITH MULTIDIRECTIONAL ORIENTATION AND RETRACTIBLE POURER TUBE

BACKGROUND OF THE INVENTION

1. Field of the Invention

The present invention relates to a leaktight stopper unit with a retractable, multidirectionally oriented pouring tube, intended to be used in combination with containers, and in particular cans containing oils, lubricants and other similar products.

2. Discussion of the Prior Art

Cans are already known intended for lubricating oils and obtained by the technique termed extrusion blow-molding, having a pouring spout and a portion in the form of a bellows in order to permit a degree of orientation. Unfortunately, this technique of extrusion blow-molding is awkward to implement by virtue of the fact that the parison must be brought out of center. Moreover, the bellows obtained gives a fairly inaccurate and limited orientation, in particular with cans with an average capacity (five liters and above). Lastly, the filling of these cans, which are then necessarily equipped with the bellows pouring tube, is awkward, difficult and hence costly.

Cans have now been proposed which are provided with separate pouring tubes which are intended to be placed on the neck of the can when the product is poured out. This monolithic pouring tube which has a base joined to a flexible portion in the form of a memory-effect bellows is intended to enable a liquid to be poured accurately in any direction whatsoever. This base has a thread complementing the external thread of the neck of the can so as to enable the pouring tube to be screwed onto said neck. It should be noted that the thread arranged on the outside of the neck is intended in the conventional manner to enable the can to be closed by means of a stopper.

Although very convenient to use, and easy and economical from the point of view of its production, this pouring tube has the disadvantage of not forming an integral part of the can and thus being stored separately when the latter is closed. Furthermore, in addition to the risks of losing the tube, one is never safe from spots of residual lubricant on the walls of the tube after use, or from the risks of dust and other impurities penetrating into the can, which is likely to clog up the equipment lubricated when the lubricant is poured out by means of the tube.

A stopper with a lid for a box is proposed in the document U.S. Pat. No. 4,560,081 and is associated with a bellows portion compressed by the lid. When the lid is opened, the retracted bellows is freed which then forms a pouring tube. This solution, adapted for boxes intended to contain drinks, is not satisfactory for containers with a neck since they do not allow use to be made of bellows which are sufficiently long to obtain a multidirectional orientation.

The present invention overcomes these disadvantages. Its subject is a leaktight stopper unit with a retractable, multidirectionally oriented pouring tube which is easy and economical to manufacture, convenient to use and forms part of the can without being irremediably connected to the latter, so as to facilitate accurate pouring out of the contents of the can or the filling of the latter.

SUMMARY OF THE INVENTION

This leaktight stopper unit with a pouring tube, for a container comprising a cylindrical neck, the outer face of which has a thread, consisting of:

a closing stopper as such having a crown or top;

a pouring tube in the form of a memory-effect bellows and multidirectionally oriented, which can be retracted into the neck and is compressed against the inner face of the crown of the closing stopper once placed on the neck, is characterized in that it also comprises a U-shaped, annular intermediate element defining two legs, an inner one and an outer one respectively, intended to straddle the essential part of the neck:

the outer face of the inner leg fitting tightly against the essential part of the inner face of the neck;

the lower end of the inner leg having a shoulder against which bears the lower end of the bellows, the upper end of which is compressed against the inner face of the crown of the stopper.

Put in other words, the present invention is characterized in that a retractable multidirectionally oriented pouring tube is combined with an intermediate element with a shape adapted on the one hand to said pouring tube and on the other hand to the neck of a container. The pouring tube is consequently permanently inside the container.

As is known, a "bellows" is a flexible portion formed by a succession of straight folds in an accordion arrangement. A "memory-effect bellows" is a bellows which can be stretched and inclined into a given position under the action of a first force and which, under the action of a force in the opposite direction, returns without any substantial distortion to its initial position or into another position.

Advantageously in practice:

the characteristic intermediate element comprises on the outer face of its outer leg an annular snap ring or engaging ridge intended to interact with a complementary snap ring or engaging ridge arranged on the lateral inner face of the closing stopper;

the outer leg of the intermediate element is intended to be snapped or screwed onto the threaded outer face of the neck of the container;

the inner face of the crown of the closing stopper has an inner cylindrical ring intended to interact with the upper end of the pouring bellows in order to ensure leaktightness;

the lower end of this cylindrical ring has a plurality of snap-fastening sectors or booth-like projections directed towards the outside and intended to interact with an annular zone arranged for this purpose at the upper end of the pouring bellows;

the lower end of the bellows is extended by a cylindrical portion which penetrates into the container and the outer face of which, arranged in the vicinity of the end, has a projection and a stop leaving a space corresponding to the length of the shoulder arranged at the end of the inner leg of the intermediate element, in order to fix the end of this cylindrical portion on said shoulder;

the lower end of the bellows is welded to the shoulder;

the outer leg of the intermediate element is threaded on both faces, on its inner face in order to interact with the outer thread of the neck and on its outer face in order to interact with the inner thread of the stopper, respectively;

the base of the neck has vertical notches intended to oppose the rotation of the intermediate element on the neck;

the portion in the form of a bellows consists of a stack of straight folds in an accordion arrangement and the thickness of which is reduced in the zones connecting one fold to the other.

The form which the invention may take and the resultant advantages will become more apparent from the exemplary embodiments which follows in conjunction with the attached figures.

Figure 1:
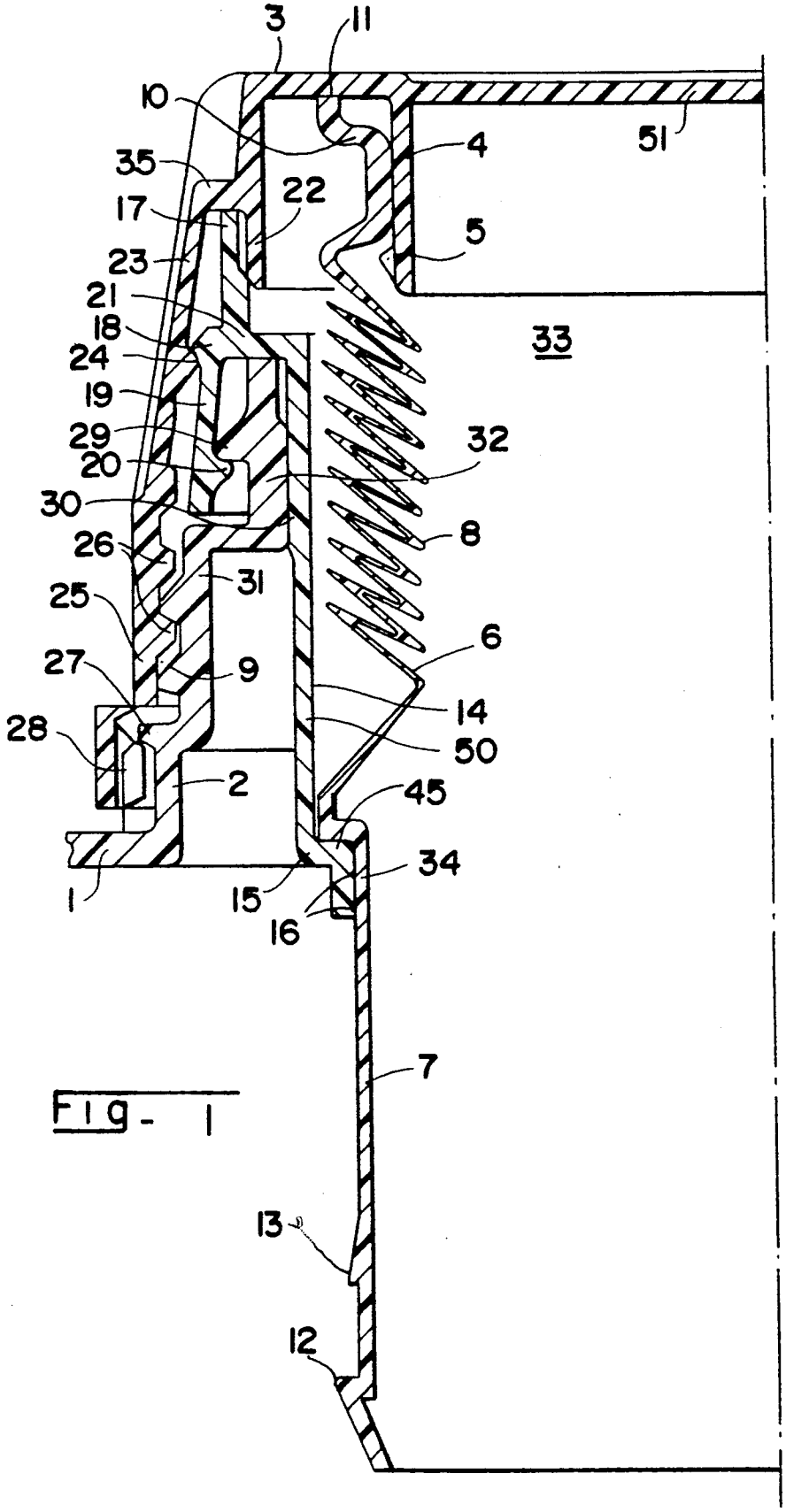
FIG. 1 is a diagrammatic view in partial cross-section of a pouring tube, characteristic of the invention, in the retracted position.

In the figures, the general reference (1) designates a can, the neck. (2) of which has on its outer face a thread (9) and an annular seal (29) whose role will be described later.

DETAILED DESCRIPTION OF THE PREFERRED EMBODIMENTS

In a first embodiment, the pouring tube according to the invention, designated by the general reference (6), is monolithic and has two portions, a lower cylindrical portion (7) connected to an upper, flexible memory-effect bellows portion (8), thus permitting inclination in all directions, the zone interconnecting the two portions (7) and (8) defining a shoulder (45) whose role will likewise be described later.

This pouring tube is advantageously made by molding a plastic, such as high-density polyethylene, or polypropylene, in particular by extrusion blow-molding.

The flexible bellows portion (8) terminates at the top in an annular zone in the form of a ring (10) intended to interact leaktightly with an inner ring (4) arranged beneath the crown of the closing stopper (3). The upper end (11) of the annular zone in the form of a ring (10) is intended to interact with the inner face of the crown (51) of the stopper (3) when the pouring tube is in the retracted position.

According to a feature of the invention, the closing stopper (3) interacts leaktightly with a U-shaped, annular, characteristic intermediate element (14), taken as a whole in the form of a cylindrical ring and the majority of which is arranged inside the neck (2) of the can (1). This annular, characteristic intermediate element (14) defines two legs, an outer one (19) and an inner one (50), respectively, and straddles the essential part of the neck (2). The outer face of the inner leg (50) fits tightly against the essential part (32) of the inner face of the neck (2). This intermediate element (14) is fixed reversably or irreversably in the region of the upper zone (32) of the neck (2) of the can (1) and this is performed by a snap-fastening by means of an annular snap ring (20) arranged on the inner face of the outer folded-over piece in the form a ring (19) of said intermediate element (14) interacting with a complementary snap ring (29) situated on the outer face of the upper zone (32) of the neck (2) of the can (1). In fact, when the intermediate element (14) is snapped onto the neck (2), the upper end (33) of said neck (2) abuts the connecting base (21) of the folded-over piece (19), thus holding said intermediate element firmly in the operational position on the neck (2).

Thus, when the intermediate element (14) is snapped onto the neck (2), there is leaktight interaction in the region of the zone referenced (30) between said intermediate element (14) and the upper zone (32) of said neck (2).

As can be seen in FIG. 1, when the pouring tube (6) is in the retracted position, the flexible bellows portion (8) is compressed between the inner face (51) of the crown of the stopper (3) in the region of the end (11) of said annular zone in the form of a ring (10), and between the shoulder (15) arranged for this purpose in the region of the inner and lower part of said intermediate element (14). This characteristic shoulder (15) interacts with the complementary shoulder (45) arranged in the region of the zone connecting the two portions, cylindrical (7) and flexible bellows portion (8), respectively, of the pouring tube (6). The inner face (34) of the end of said shoulder (15) of the intermediate element (14) has annular snap rings (16) intended to enable the cylindrical portion (7) of the pouring tube (6) to slide in a "leaktight" manner in particular so as to enable said pouring tube (6) to come out of the neck (2).

Figure 2:
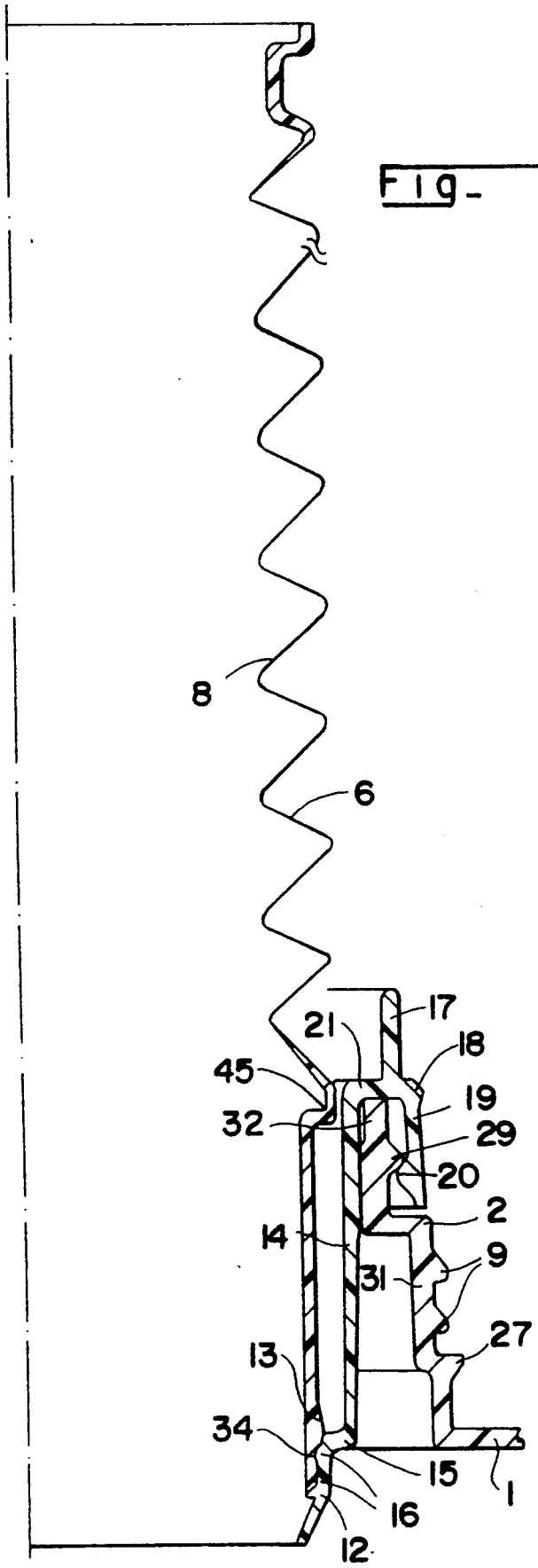
FIG. 2 is a diagrammatic view, likewise in cross-section, of the pouring tube according to the invention but in the operational pouring position.

The sliding travel of the cylindrical portion (7) of the pouring tube (6) is limited by means of a socalled retaining stop (12) intended to interact with the lower end of the shoulder (15) of the intermediate element (14). In addition, and as can be seen in FIG. 2, so as to prevent the pouring tube slipping inadvertently inside the can (1) when in use, the cylindrical portion (7) is held in place when the pouring tube is out by means of a projection (13) performing the role of a snap-fastening, and retaining the shoulder (15) of the intermediate element (14) between this said projection (13) and the retaining stop (12). In fact, the distance separating the projection (13) from the retaining stop (12) substantially corresponds, within the tolerances to the length of the inner face (33) of said shoulder (15). In addition, in order to enable the whole flexible bellows zone (8) to come out of the can (1), the distance separating the shoulder (45) from the retaining stop (12) corresponds substantially to the length of the cylindrical portion of the intermediate element (14) situated inside said can (1).

According to another feature of the invention, the lower end of the inner ring (4) situated beneath the crown of the stopper (3) has snap-fastening sectors directed towards the outside and intended to interact with a lower recess situated beneath the annular zone in the form of a ring (10) of the flexible portion (8) of the pouring tube (6) so as to maintain it axially compressed when it is not in the operational position, in other words, when it does not project out of the neck (2) of the can (1).

According to another feature of the invention, the connecting base (21) of the folded-over piece (19) of the intermediate element (14) has an annular projection (18) directed towards the outside and intended to interact leaktightly with an annular snap ring (24) arrranged in the region of the inner face of the stopper (3). The stopper (3) may consequently be snapped onto the intermediate element (14) independently of the can (1), in other words, without being screwed onto the thread (9) of the neck (2). When said stopper (3) is snapped onto the intermediate element (14), an upper annular ring (17) integrally formed on the connecting base (21) of the folded-over piece (19) of the intermediate element (14) abuts a shoulder (35) arrranged in the vicinity of the crown of the stopper (3). In addition, so as to increase the leaktightness of the unit, said upper annular ring (17) coaxial and larger relative to said ring (4), interacts with an inner ring (22) of the stopper (3). Also, the upper annular ring (17) defines and with the lateral wall (23) of the stopper (3) a shoulder (35).

The stopper (3) has, in a known manner, in the lower region of its inner face, a thread (26) intended to interact with the thread (9) arranged in the region of the neck (2) of the can (1).

The lower end of the stopper (3) has, in a likewise known manner, fastening sectors (28) intended to snap into place in the region of an annular snap ring (27) arranged at the base of the neck (2) of the can (1), so as to prevent said stopper from being inadvertently unscrewed.

In practice, the characteristic intermediate element (14) and the stopper (3) are made by molding a plastic, in particular low-density polyethylene.

Figure 3:
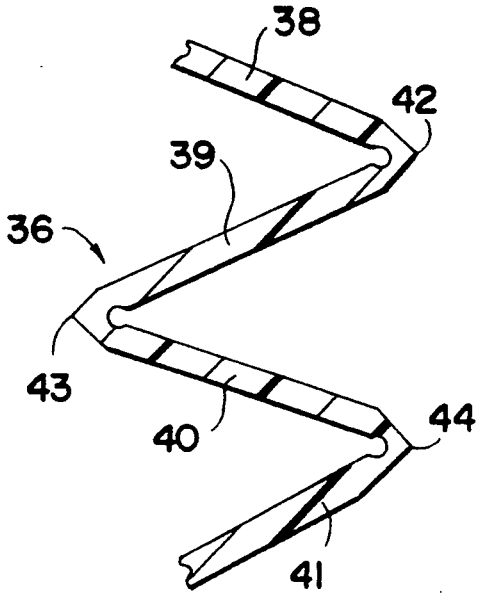
FIG. 3 is a detailed view of the zone connecting two straight folds of the bellows which is a component of the pouring tube.

The flexible bellows part (8) of the pouring tube (6) according to the invention is formed from basic straight folds (36) shown in detail in FIG. 3. Each of these straight folds is formed by joining two inclined planes (38, 39, 40, 41), thus forming bending zones (42, 43, 44). The thickness of the basic folds in the region of these bending zones is reduced in each of the zones connecting one fold to another.

The unit consisting of the retractable pouring tube (6), the intermediate element (14) and the stopper (3) thus constitues a body joined together simply by the stopper (3) snapping onto the intermediate element (14), thus axially compressing the bellows portion (8) of said tube (6) between the crown of the stopper (3) and the shoulder (15) of the lower end of the intermediate element (14). In fact, it proves to be extremely easy to fill the can (1).

When the user desires to pour out the contents of the can (1), he pierces the covering film, and then screws the stopper (3) onto the can (1), said stopper being provided with the pouring tube, with the intermediate element and with the stopper (3) as such. He screws the stopper (3) until the intermediate element (14) snaps onto the upper part (32) of the neck (2) of the can (1), and he then need only unscrew said stopper in order to free the pouring tube (6). He then orients the flexible bellows portion (8) in the desired direction after having pulled out the latter until the shoulder (15) snaps in between the projection (13) and the retaining stop (12) of the lower part of the sliding cylindrical portion (7) of said tube.

Once the filling is complete, the user replaces the pouring tube inside the neck simply by pressing down gently, and recompresses axially the bellows part (8) of the tube (6) by means of the stopper (3). He then screws back on the latter in an entirely conventional manner.

Figure 4:
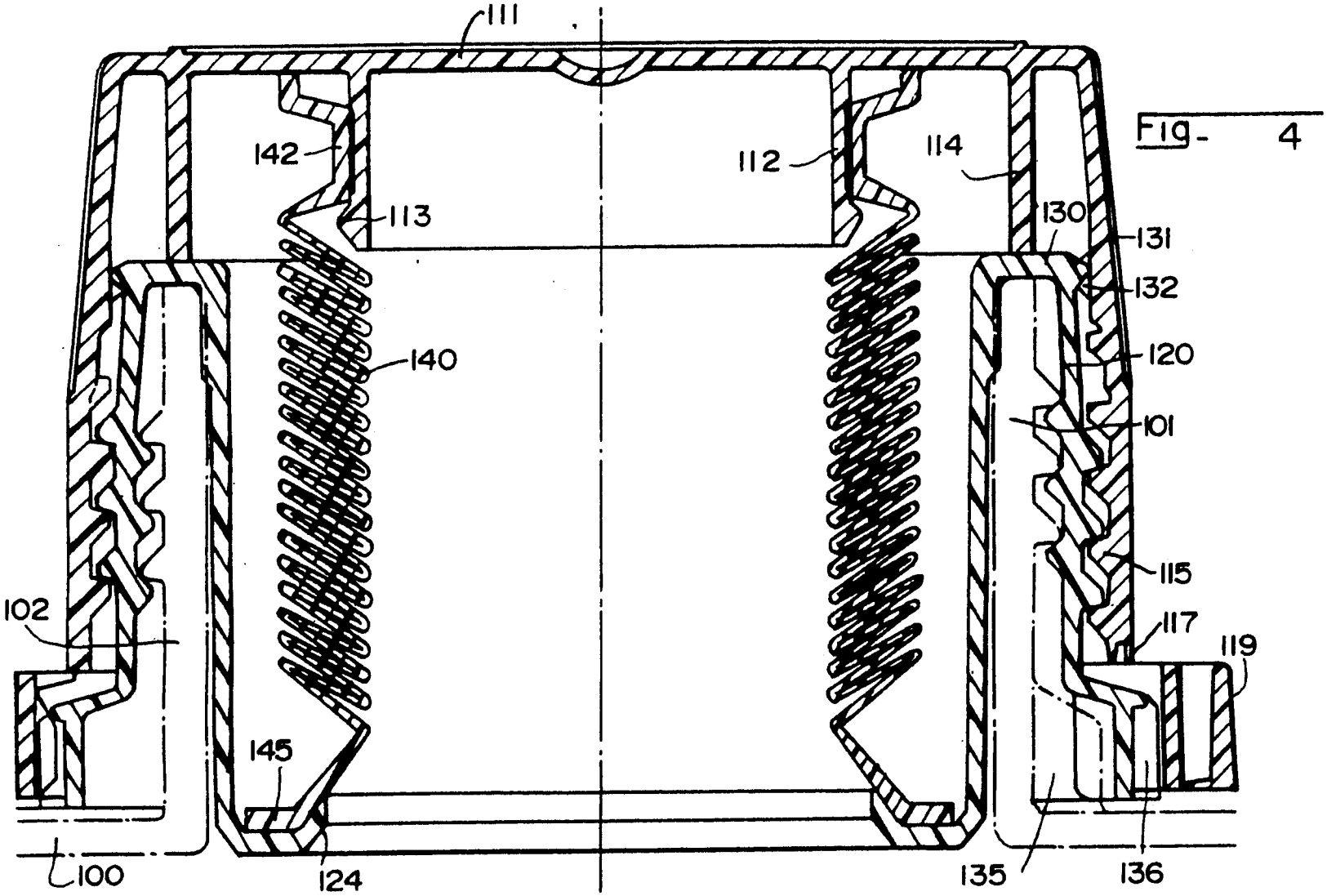
FIG. 4 is a view in cross-section of a preferred embodiment of the invention, shown in partial detail in FIG. 5.
Figure 5:
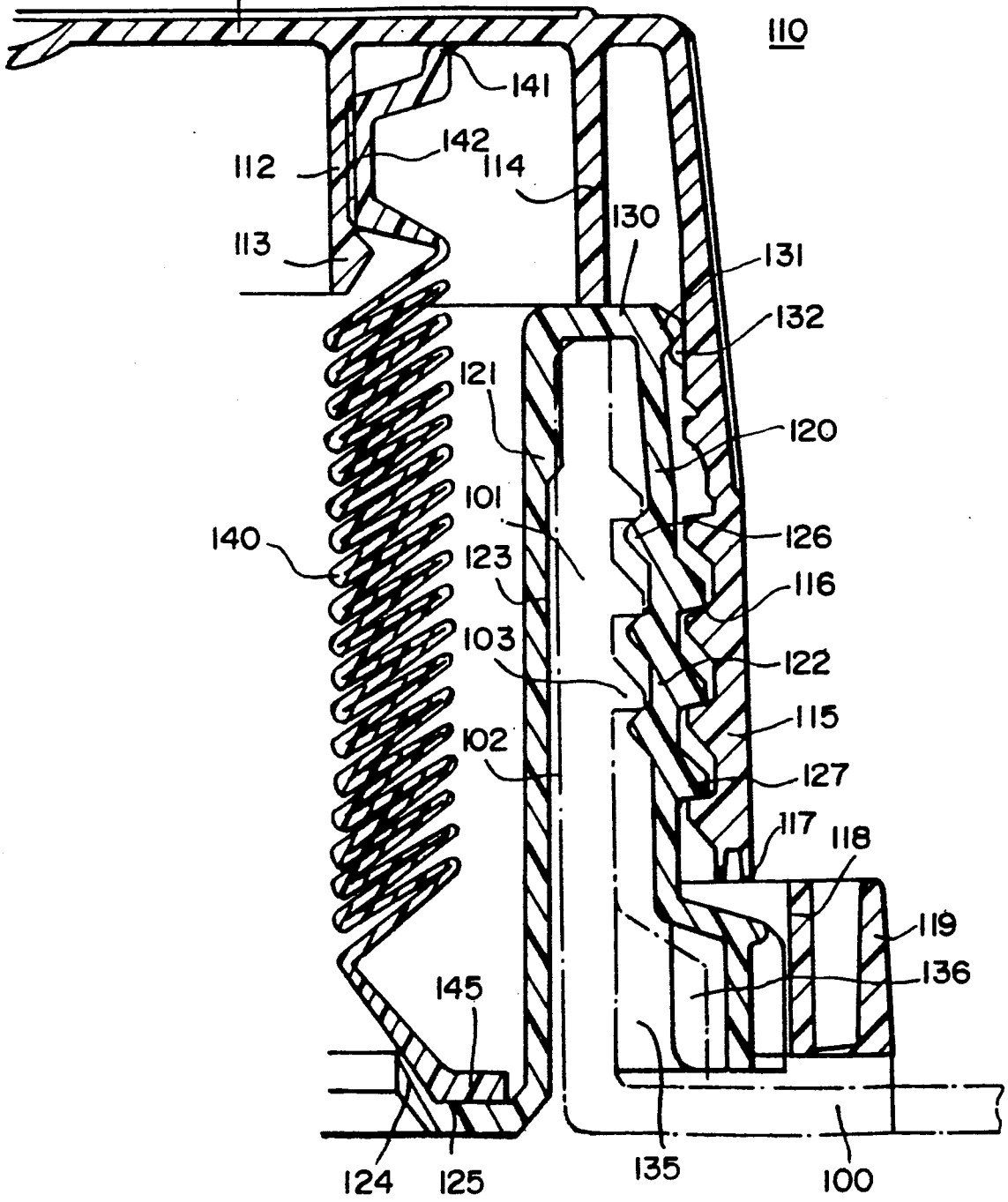

As already mentioned, FIGS. 4 and 5 show a preferred embodiment of the invention. Here the container (100) comprises a neck (101) whose inner face (102) is substantially cylindrical and vertical and whose outer face has a thread (103).

The reference (110) designates a stopper formed from a crown (111), sometimes termed "a ceiling", having an annular sealing skirt (112), the end (113) of which has fastening sectors (113) directed towards the outside. (114) designates an annular bearing and stacking skirt, and (115) designates the flank of the closing stopper (110) whose inner face has a thread (116). The bottom (117) of this flank is joined by tearable bridges (not shown) to a tamperproof band (118) formed in a known manner. (119) designates a tongue, also known, enabling this tamperproof band (118) to be detached. According to a feature of the invention, the stopper unit comprises an annular intermediate element, designated by the general reference (120), in the form of a U defining two legs, and inner one (121) and an outer one (122), respectively, which straddle the neck (102). The outer face (123) of the inner leg (121) is substantially vertical and cylindrical in order to fit tightly against the inner face (102) of the neck (101). The lower end (124) of this inner leg (121) has a shoulder (125) directed towards the inside of the neck (102). The outer leg (122) has, on its inner face, a thread (126) intended to interact with the thread (103) of the neck (102). On the other hand, the outer face (127) also has a thread intended to interact with the thread (116) provided on the inner face of the flank (115) of the closing stopper (110). The connecting portion (130) of the two legs (121) and (122) has, directed towards the outside, a circular snap ring (131) intended to interact with complementary fastening sectors (132) provided on the inner face of the flank (115). The reference (135) designates vertical notches provided on the neck (102) in order to prevent the return of the intermediate piece (120). The reference (136) designates notches, likewise vertical, provided at the base of the intermediate piece (120) in order to prevent the backward return of the intermediate part (120).

The bellows designated by the general reference (140) bears at its end (141) against the inner face (111) of the crown and has a pouring spout (142) which bears against the annular skirt (112). This bellows (140) has a plurality of corrugations, for example eighteen corrugations as shown in the drawing. According to a feature of the invention, the lower end (145) of the bellows (140) bears against the shoulder (125). This lower end (145) is advantageously welded onto this shoulder (125), preferably by ultrasonics.

After having removed the tamperproof collar (118) and unscrewed the stopper (110), the bellows (140) is freed and may be easily pulled upwards. The bellows (140) is then in the use position and can thus be oriented in the desired direction.

By way of the diametrical clamping of the skirt (112) on the ring (142), of the leg (121) of the intermediate piece (120) on the inner face (102) of the neck (100) (sic), and by way of the welding of the end (145) on the shoulder (125), the unit is entirely leaktight, in particular with respect to oils.

The device according to the invention has numerous advantages as compared with those currently marketed. For example:

the fact that the pouring tube forms an integral part of the can;

the fact that the characteristic intermediate piece matches the internal shape of the neck, which ensures an integral pouring from the can;

added leaktightness which enables the cleanness of such cans to be significantly increased;

the possibility of obtaining an integral body composed of the stopper, the intermediate element and the pouring tube as such thus guaranteeing an easier filling of the cans and the possibility of obtaining accurate multidirectional orientation, and hence reliability and convenience for the user.

Cans equipped with this stopper and pouring unit may thus be used successfully as containers for which accurate and multidirectional pouring of a wide variety of liquids is desired, such as, in particular, lubricating oils, corrosive or non-corrosive chemical products, etc.

We claim:

1. A leaktight stopper unit and pouring tube for a container having an opening surrounded by a cylindrical neck, comprising:

an annular intermediate element comprising inner and outer generally cylindrical sleeves connected by a top surface, having a U-shaped cross-section and defining a cylindrical cavity for placement over the cylindrical neck of the container;

said pouring tube including a memory effect bellows and which is retractable into the annular intermediate element;

said stopper unit including a removable closing stopper having a top portion such that an inner face of said top portion contacts the top of said pouring tube to compress said pouring tube in a retracted position substantially within the annular intermediate element; and said inner sleeve of the annular intermediate element is sized to fit snugly within the cylindrical neck of the container and additionally comprises an inwardly extending shoulder flange for retaining the pouring tube within the intermediate element.

2. The leaktight stopper unit and pouring tube of claim 1 further comprising:

an annular engaging ridge on the outer face of said outer sleeve of said intermediate element and a complementary engaging ridge on an inner lateral face of a generally cylindrical skirt portion of said closing stopper which ridges are cooperable to hold the stopper on the intermediate element.

3. The leaktight stopper unit and pouring tube of claim 1 wherein the inner face of the outer sleeve of said annular intermediate element is threads on the for interacting with a threaded cylindrical neck.

4. A leaktight stopper unit and pouring tube of claim 1 wherein the outer surface of said outer sleeve of the annular intermediate member and the inner surface of the generally cylindrical skirt portion of the closing stopper are threaded and cooperable to hold the stopper on the intermediate element.

5. The leaktight stopper unit and pouring tube of claim 1 additionally comprising leaktight seal between said pouring tube and said closing stopper, said leaktight seal comprising an annular ring portion of said pouring tube near the top of said tube and an inner ring portion extending axially downwardly from the inner face of the top portion of the closing stopper.

6. The leaktight stopper unit and pouring tube of claim 5 wherein the inner ring extending from the inner face of the top portion of said closing stopper comprises a plurality of tooth-like projections the exterior surface of the lower end of which include an engaging ridge portion for snap fitting that inner ring within the annular ring at the top of the pouring tube.

7. The leaktight stopper unit and pouring tube of claim 1 additionally comprising a weld between said shoulder at the lower end of the inner sleeve of the intermediate member and said pouring tube.

8. The leaktight stopper unit and pouring tube of claim 1 wherein the pouring tube additionally comprises a lower cylindrical portion connected with the memory effect bellows thereby defining a linearly extendable pouring tube, said lower cylindrical portion having near its lower end a retaining stop and projection for releasably connecting with the shoulder flange of the inner sleeve of said intermediate element.

* * * * *